US009734750B2

(12) United States Patent
Chen

(10) Patent No.: US 9,734,750 B2
(45) Date of Patent: Aug. 15, 2017

(54) METHOD OF SETTING GREY LEVELS OF PIXELS ON LCD PANEL

(71) Applicant: Shenzhen China Star Optoelectronics Technology Co., Ltd., Shenzhen, Guangdong (CN)

(72) Inventor: Lixuan Chen, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 14/787,824

(22) PCT Filed: May 18, 2015

(86) PCT No.: PCT/CN2015/079225

§ 371 (c)(1),
(2) Date: Oct. 29, 2015

(87) PCT Pub. No.: WO2016/173008

PCT Pub. Date: Nov. 3, 2016

(65) Prior Publication Data

US 2017/0053586 A1 Feb. 23, 2017

(30) Foreign Application Priority Data

Apr. 29, 2015 (CN) ..... 2015 1 0212455

(51) Int. Cl.

*G09G 3/20* (2006.01)
*G09G 3/36* (2006.01)
*G09G 5/10* (2006.01)

(52) U.S. Cl.

CPC ..... *G09G 3/2074* (2013.01); *G09G 3/36* (2013.01); *G09G 3/3607* (2013.01); *G09G 5/10* (2013.01);

(Continued)

(58) Field of Classification Search

CPC ..... G09G 3/2074; G09G 3/3607; G09G 3/36; G09G 5/10; G09G 2300/0452; G09G 2320/0666; G09G 2320/0276

See application file for complete search history.

(56) References Cited

U.S. PATENT DOCUMENTS

2008/0079746 A1* 4/2008 Ou-Yang ..... G09G 5/02 345/589
2009/0174638 A1* 7/2009 Brown Elliott ... G02F 1/133621 345/88

(Continued)

FOREIGN PATENT DOCUMENTS

CN 102394041 A 3/2012
CN 104157255 A 11/2014

*Primary Examiner* — Christopher E Leiby
(74) *Attorney, Agent, or Firm* — Andrew C. Cheng

(57) ABSTRACT

A method of setting grey levels of pixels includes: acquiring tristimulus values of each grey level applied on a main subpixel region and a secondary subpixel region in a front view and in a side view; acquiring ideal luminance values for showing white at an ith grey level applied on the pixel in the front view and in the side view, where i∈[m,n], m indicates a minimum grey level and n indicates a maximum grey level; determining actual grey levels for showing white at the ith grey level applied on main subpixel region and secondary subpixel region of all pixels, according to the ideal luminance values, tristimulus values of each grey level applied on main subpixel region and secondary subpixel region in the front view and in the side view. By using the method, gray levels of pixels imaging of LCD panels can be effectively and precisely set.

7 Claims, 2 Drawing Sheets

(52) U.S. Cl.
CPC ..... *G09G 2300/0452* (2013.01); *G09G 2320/0276* (2013.01); *G09G 2320/0666* (2013.01)

(56) References Cited

U.S. PATENT DOCUMENTS

| | | | | |
|---|---|---|---|---|
| 2013/0229430 | A1* | 9/2013 | Chen | G09G 5/02 345/600 |
| 2014/0118427 | A1* | 5/2014 | Buckley | G09G 3/36 345/691 |
| 2014/0152687 | A1* | 6/2014 | Liu | G09G 5/026 345/590 |
| 2014/0375669 | A1* | 12/2014 | Zhang | G09G 5/02 345/589 |
| 2015/0130827 | A1* | 5/2015 | Mizushiro | H04N 9/3182 345/589 |

* cited by examiner

METHOD OF SETTING GREY LEVELS OF PIXELS ON LCD PANEL

BACKGROUND OF THE INVENTION

1. Field of the Invention

The present invention relates to a liquid crystal display (LCD) technology, more particularly to a method for setting gray levels of pixels of LCD panels.

2. Description of the Prior Art

LCD devices, being small, light, and with high display quality, have gradually replaced cathode ray tube (CRT) displays. An LCD panel is constructed by pixels arranged in matrices. Each pixel is constructed by subpixels that show colors, e.g. the red subpixel, the green pixel, and the blue subpixel. Brightness of each subpixel is determined by its own gray level as well as brightness of the panel's backlight module. The most common display method, however, is to keep the latter at a constant level while rotating, based on the image data input, the liquid-crystal molecules of each subpixel by various gray-level voltages. The rotation angles can then determine transparency of each subpixel, and thus determine its gray level in display.

As application of LCD devices broadens, a wider viewing angle is demanded, thus bringing to market such products, e.g. MVA LCD. This kind of LCD applies wide-angle image display via 2D1G technology, white balance technology, and so on. Please refer to FIG. 1 illustrating the structure of pixels on an LCD panel using 2D1G technology. The pixels include red subpixels, green subpixels, and blue subpixels. Each of the subpixels contains a main subpixel region and a secondary subpixel region. As shown in FIG. 1, upon receiving image data, the 2D1G technology is used to impose respective gray-level voltages on the main and secondary subpixel regions of each of the subpixels, in order that the pixels can display respective levels of brightness. Then, the white balance technology is used to impose respective gray-level voltages on each of the subpixels, in order that the pixels can display respective levels of whiteness. However, after the white balance process, the result of the former 2D1G process is usually affected. The gamma curve of each of the subpixels does not fit perfectly anymore in the gamma value 2.2, thus leading to phenomena such as color shift and light leakage in wide-angle displays.

SUMMARY OF THE INVENTION

A preferred embodiment of the present invention offers a method for setting gray levels of pixels imaging of LCD panels, reducing problems common in wide-angle displays such as color shift and light leakage.

According to the present invention, a method of setting grey levels of pixels on a liquid crystal display (LCD) panel is proposed. Each pixel comprises a red subpixel, a green subpixel, and a blue subpixel, and each subpixel comprises a main subpixel region and a secondary subpixel region. The method comprises: acquiring tristimulus values of each grey level applied on the main subpixel region and tristimulus values of each grey level applied on the secondary subpixel region in a front view, and acquiring tristimulus values of each grey level applied on the main subpixel region and tristimulus values of each grey level applied on the secondary subpixel region in a side view; acquiring ideal luminance values for showing white at an ith grey level applied on the pixel in the front view and in the side view, where i∈[m,n], m indicates a minimum grey level applied on the pixel and n indicates a maximum grey level applied on the pixel;

determining actual grey levels for showing white at the ith grey level which are applied on the main subpixel region and the secondary subpixel region of all pixels, according to the ideal luminance values, the tristimulus values of each grey level applied on the main subpixel region and applied on the secondary subpixel region in the front view, and tristimulus values of each grey level applied on the main subpixel region and applied on the secondary subpixel region in the side view.

Optionally, a step of determining actual grey levels for showing white at the ith grey level which are applied on the main subpixel region and the secondary subpixel region of all pixels, according to the ideal luminance values, the tristimulus values of each grey level applied on the main subpixel region and applied on the secondary subpixel region in the front view, and tristimulus values of each grey level applied on the main subpixel region and applied on the secondary subpixel region in the side view, comprises: determining a grey level $RM_i$ as an actual grey level applied on a main subpixel region of the red subpixel, determining a grey level $RS_i$ as an actual grey level applied on a secondary subpixel region of the red subpixel, determining a grey level $GM_i$ as an actual grey level applied on a main subpixel region of the green subpixel, determining a grey level $GS_i$ as an actual grey level applied on a secondary subpixel region of the green subpixel, determining a grey level $BM_i$ as an actual grey level applied on a main subpixel region of the blue subpixel, determining a grey level $BS_i$ as an actual grey level applied on a secondary subpixel region of the blue subpixel, where the grey levels $RM_i$, $RS_i$, $GM_i$, $GS_i$, $BM_i$, and $BS_i$ indicate to the actual grey levels for showing white at the ith grey level, upon a condition that Δ1, Δ2, Δ3, Δ4, Δ5, and Δ6 meet a predetermined criterion, where Δ1, Δ2, Δ3, Δ4, Δ5 and Δ6 are obtained based on the following formulas:

$$\Delta 1=x_i-(RM_i(X)+GM_i(X)+BM_i(X)+RS_i(X)+GS_i(X)+BS_i(X))/S,$$

$$\Delta 2=y_i-(RM_i(Y)+GM_i(Y)+BM_i(Y)+RS_i(Y)+GS_i(Y)+BS_i(Y))/S,$$

$$\Delta 3=RM_i(Y)+GM_i(Y)+BM_i(Y)+RS_i(Y)+GS_i(Y)+BS_i(Y)-Lv_i,$$

$$\Delta 4=x_i-(RM_i(X)'+GM_i(X)'+BM_i(X)'+RS_i(X)'+GS_i(X)'+BS_i(X)')/S',$$

$$\Delta 5=y_i-(RM_i(Y)'+GM_i(Y)'+BM_i(Y)'+RS_i(Y)'+GS_i(Y)'+BS_i(Y)')/S',$$

$$\Delta 6=RM_i(Y)'+GM_i(Y)'+BM_i(Y)'+RS_i(Y)'+GS_i(Y)'+BS_i(Y)'-Lv_i',$$

where $(x_i, y_i)$ indicates to a coordinate of the ith grey level to show white in a CIE1931 color space, $Lv_i$ and $Lv_i'$ indicate to the ideal luminance values for showing white at an ith grey level applied on the pixel in the front view and in the side view, respectively, and $$S=RM_i(X)+RM_i(Y)+RM_i(Z)+GM_i(X)+GM_i(Y)+GM_i(Z)+BM_i(X)+BM_i(Y)+BM_i(Z)+RS_i(X)+RS_i(Y)+RS_i(Z)+GS_i(X)+GS_i(Y)+GS_i(Z)+BS_i(X)+BS_i(Y)+BS_i(Z),$$

$$S'=RM_i(X)'+RM_i(Y)'+RM_i(Z)'+GM_i(X)'+GM_i(Y)'+GM_i(Z)'+BM_i(X)'+BM_i(Y)'+BM_i(Z)'+RS_i(X)'+RS_i(Y)'+RS_i(Z)'+GS_i(X)'+GS_i(Y)'+GS_i(Z)'+BS_i(X)'+BS_i(Y)'+BS_i(Z)',$$

Where $RM_i(X)$, $RM_i(Y)$, $RM_i(Z)$ indicate to tristimulus values of the grey level $RM_i$ applied on the main subpixel region of the red subpixel in the front view, $RM_i(X)''$, $RM_i(Y)'$, $RM_i(Z)'$ indicate to tristimulus values of the grey level $RM_i$ applied on the main subpixel region of the red subpixel in the side view, $RS_i(X)$, $RS_i(Y)$, $RS_i(Z)$ indicate to tristimulus values of the grey level $RS_i$ applied on the secondary subpixel region of the red subpixel in the front view, $RS_i(X)'$, $RS_i(Y)'$, $RS_i(Z)'$ indicate to tristimulus values of the grey level $RS_i$ applied on the secondary subpixel region of the red subpixel in the side view, $GM_i(X)$, $GM_i(Y)$, $GM_i(Z)$ indicate to tristimulus values of the grey level $GM_i$ applied on the main subpixel region of the green subpixel in the front view, $GM_i(X)'$, $GM_i(Y)'$, $GM_i(Z)'$ indicate to tristimulus values of the grey level $GM_i$ applied on the main subpixel region of the green subpixel in the side view, $GS_i(X)$, $GS_i(Y)$, $GS_i(Z)$ indicate to tristimulus values of the grey level $GS_i$ applied on the secondary subpixel region of the green subpixel in the front view, $GS_i(X)'$, $GS_i(Y)'$, $GS_i(Z)'$ indicate to tristimulus values of the grey level $GS_i$ applied on the secondary subpixel region of the green subpixel in the side view, $BM_i(X)$, $BM_i(Y)$, $BM_i(Z)$ indicate to tristimulus values of the grey level $BM_i$ applied on the main subpixel region of the blue subpixel in the front view, $BM_i(X)'$, $BM_i(Y)'$, $BM_i(Z)'$ indicate to tristimulus values of the grey level $BM_i$ applied on the main subpixel region of the blue subpixel in the side view, $BS_i(X)$, $BS_i(Y)$, $BS_i(Z)$ indicate to tristimulus values of the grey level $BS_i$ applied on the secondary subpixel region of the blue subpixel in the front view, and $BS_i(X)'$, $BS_i(Y)'$, $BS_i(Z)'$ indicate to tristimulus values of the grey level $BS_i$ applied on the secondary subpixel region of the blue subpixel in the side view.

Optionally, the predetermined criterion is one of the following criteria: $\Delta=\Delta1+\Delta2+\Delta3+\Delta4+\Delta5+\Delta6$ is minimum, or $\Delta=\Delta1^2+\Delta2^2+\Delta3^2+\Delta4^2+\Delta5^2+\Delta6^2$ is minimum, or $\Delta=a\Delta1^2+b\Delta2^2+c\Delta3^2+d\Delta4^2+e\Delta5^2+f\Delta6^2$ is minimum, where a, b, c, d, e, and f are weighed factors.

Optionally, a step of acquiring ideal luminance values for showing white at an ith grey level applied on the pixel in the front view and in the side view, comprises:

acquiring ideal luminance values $Lv_i$ and $Lv_i'$ for showing white at an ith grey level applied on the pixel in the front view and in the side view based on following equations:

$$Lv_i=Lv(n)*(i/n)^{\gamma}, \text{ and}$$

$$Lv_i'=Lv(n)'*(i/n)^{\gamma},$$

where Lv(n) and Lv(n)' indicate to actual luminance values for showing white at an nth grey level applied on the pixel in the front view and in the side view, respectively, and $\gamma$ is a predetermined gamma value.

Optionally, $\gamma$ is equal to 2.2.

Optionally, m is equal to 0, and n is equal to 255.

Optionally, the front view indicates an observer view the LCD panel in a viewing angle of 0° from a perpendicular direction of the LCD panel, and the side view indicates an observer view the LCD panel in a predetermined viewing angle from the perpendicular direction of the LCD panel.

Optionally, the predetermined viewing angle is 60°.

By using the method of the preferred embodiment of the present invention, the white balance procedures can be effectively processed, thus setting gray levels of pixels imaging of LCD panels effectively and precisely, reducing problems common in wide-angle displays such as color shift and light leakage.

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF THE PREFERRED EMBODIMENTS

Figure 1:
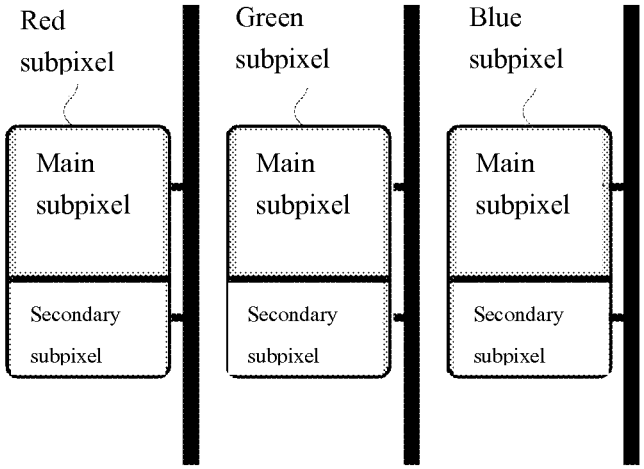
Fig. 1 (Prior art)
FIG. 1 shows a schematic diagram of a pixel of a conventional LCD panel adopting 2D1G technology.

Although the present invention has been explained by the embodiments shown in the drawings described above, it should be understood to the ordinary skilled person in the art that the invention is not limited to the embodiments, but rather various changes or modifications thereof are possible without departing from the spirit of the invention. Accordingly, the scope of the invention shall be determined only by the appended claims and their equivalents.

Figure 2:
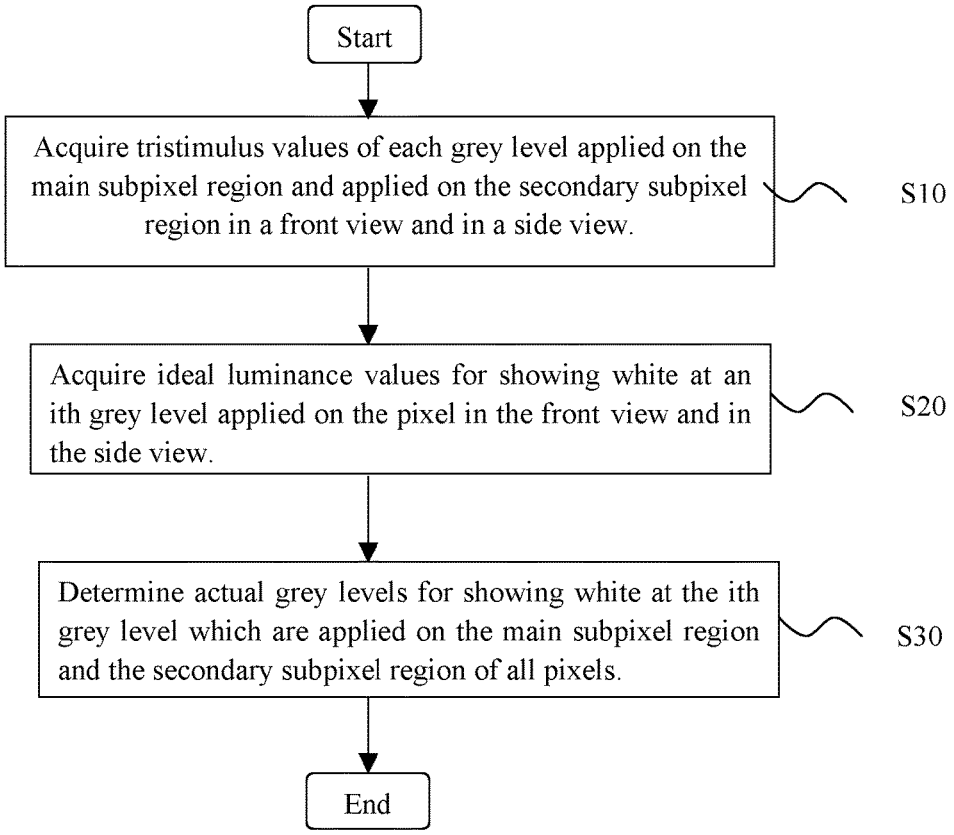
FIG. 2 shows a flowchart of a method of setting grey levels of pixels on a liquid crystal display (LCD) panel according to preferred embodiment of the present invention.

Please refer to FIG. 2 showing a flowchart of a method of setting grey levels of pixels on a liquid crystal display (LCD) panel according to preferred embodiment of the present invention. The LCD panel comprises a plurality of pixels, each pixel having a red subpixel, a green subpixel and a blue subpixel. Eacg subpixel comprises a main subpixel region and a secondary subpixel region.

Step S10 illustrates acquiring tristimulus values of each grey level applied on the main subpixel region and tristimulus values of each grey level applied on the secondary subpixel region in a front view, and acquiring tristimulus values of each grey level applied on the main subpixel region and tristimulus values of each grey level applied on the secondary subpixel region in a side view. That is, the step S10 comprises: acquiring tristimulus values of each grey level applied on the main subpixel region of the red subpixel and tristimulus values of each grey level applied on the secondary subpixel region of the red subpixel in the front view, acquiring tristimulus values of each grey level applied on the main subpixel region of the red subpixel and tristimulus values of each grey level applied on the secondary subpixel region of the red subpixel in the side view, acquiring tristimulus values of each grey level applied on the main subpixel region of the green subpixel and tristimulus values of each grey level applied on the secondary subpixel region of the green subpixel in the front view, acquiring tristimulus values of each grey level applied on the main subpixel region of the green subpixel and tristimulus values of each grey level applied on the secondary subpixel region of the green subpixel in the side view, acquiring tristimulus values of each grey level applied on the main subpixel region of the blue subpixel and tristimulus values of each grey level applied on the secondary subpixel region of the blue subpixel in the front view, acquiring tristimulus values of each grey level applied on the main subpixel region of the blue subpixel and tristimulus values of each grey level applied on the secondary subpixel region of the blue subpixel in the side view.

The front view indicates an observer view the LCD panel in a viewing angle of 0° from a perpendicular direction of the LCD panel, and the side view indicates an observer view the LCD panel in a predetermined viewing angle from the perpendicular direction of the LCD panel. The predetermined viewing angle is between 30°~80°. Preferably, the predetermined viewing angle is 60°.

The tristimulus values of each grey level applied on the main subpixel region and tristimulus values of each grey level applied on the secondary subpixel region can be acquired by conventional methods.

Step S20 illustrates acquiring ideal luminance values for showing white at an ith grey level applied on the pixel in the front view and in the side view, where i∈[m,n], m indicates a minimum grey level applied on the pixel and n indicates a maximum grey level applied on the pixel.

The number of grey levels applied on the pixel depends on types of the LCD panel. For example, for a 8-bit LCD panel, the number of grey levels is 256, in which a minimum grey level n is 0 and a maximum grey level m is 255. Correspondingly, the acquired tristimulus values of each grey level in step S10 indicate to tristimulus values of all grey levels 0, 1, 2, . . . , 255.

For example, for a 10-bit LCD panel, the number of grey levels is 1024, in which a minimum grey level n is 0 and a maximum grey level m is 1023. Correspondingly, the acquired tristimulus values of each grey level in step S10 indicate to tristimulus values of all grey levels 0, 1, 2 . . . , 1023.

The ideal luminance values for showing white at an ith grey level applied on the pixel in the front view and in the side view, can be acquired by conventional methods.

For example, the ideal luminance values $Lv_i$ and $Lv_i'$ for showing white at an ith grey level applied on the pixel in the front view and in the side view, can be acquired by the following equations:

$$Lv_i=Lv(n)*(i/n)^{\gamma}$$

$$Lv_i'=Lv(n)*(i/n)^{\gamma} \quad (2),$$

where Lv(n) and Lv(n)' indicate to actual luminance values for showing white at an nth grey level applied on the pixel in the front view and in the side view, respectively, and γ is a predetermined gamma value. Preferably, γ is equal to 2.2.

The Lv(n) and Lv(n)' can be acquired by conventional methods. For example, a luminance value for showing white at an nth grey level applied on the pixel in the front view is measured to be as Lv(n), while a luminance value for showing white at an nth grey level applied on the pixel in the side view is measured to be as Lv(n)'.

Step S30 illustrates determining actual grey levels for showing white at the ith grey level which are applied on the main subpixel region and the secondary subpixel region of all pixels, according to the ideal luminance values, the tristimulus values of each grey level applied on the main subpixel region and applied on the secondary subpixel region in the front view, and tristimulus values of each grey level applied on the main subpixel region and applied on the secondary subpixel region in the side view.

Specifically, actual grey levels for showing white at the ith grey level which are applied on the main subpixel region and the secondary subpixel region of all pixels are determined, according to the ideal luminance values $Lv_i$ and $Lv_i'$, an actual grey level $RM_i$ applied on a main subpixel region of the red subpixel, an actual grey level $RS_i$ applied on a secondary subpixel region of the red subpixel, an actual grey level $GM_i$ applied on a main subpixel region of the green subpixel, an actual grey level $GS_i$ applied on a secondary subpixel region of the green subpixel, an actual grey level $BM_i$ applied on a main subpixel region of the blue subpixel, an actual grey level $BS_i$ applied on a secondary subpixel region of the blue subpixel.

Preferably, upon a condition that Δ1, Δ2, Δ3, Δ4, Δ5, and Δ6 meet a predetermined criterion, a grey level $RM_i$ is determined as an actual grey level applied on a main subpixel region of the red subpixel, a grey level $RS_i$ is determined as an actual grey level applied on a secondary subpixel region of the red subpixel, a grey level $GM_i$ is determined as an actual grey level applied on a main subpixel region of the green subpixel, a grey level $GS_i$ is determined as an actual grey level applied on a secondary subpixel region of the green subpixel, a grey level $BM_i$ is determined as an actual grey level applied on a main subpixel region of the blue subpixel, a grey level $BS_i$ is determined as an actual grey level applied on a secondary subpixel region of the blue subpixel. The grey levels $RM_i$, $RS_i$, $GM_i$, $GS_i$, $BM_i$, and $BS_i$ indicate to the actual grey levels for showing white at the ith grey level. Δ1, Δ2, Δ3, Δ4, Δ5, and Δ6 are obtained based on the following formulas:

$$\Delta 1=x_i-(RM_i(X)+GM_i(X)+BM_i(X)+RS_i(X)+GS_i(X)+BS_i(X))/S \quad (3),$$

$$\Delta 2=y_i-(RM_i(Y)+GM_i(Y)+BM_i(Y)+RS_i(Y)+GS_i(Y)+BS_i(Y))/S \quad (4),$$

$$\Delta 3=RM_i(Y)+GM_i(Y)+BM_i(Y)+RS_i(Y)+GS_i(Y)+BS_i(Y)-Lv_i \quad (5),$$

$$\Delta 4=x_i-(RM_i(X)'+GM_i(X)'+BM_i(X)'+RS_i(X)'+GS_i(X)'+BS_i(X)')/S' \quad (6),$$

$$\Delta 5=y_i-(RM_i(Y)'+GM_i(Y)'+BM_i(Y)'+RS_i(Y)'+GS_i(Y)'+BS_i(Y)')/S' \quad (7),$$

$$\Delta 6=RM_i(Y)'+GM_i(Y)'+BM_i(Y)'+RS_i(Y)'+GS_i(Y)'+BS_i(Y)'-Lv_i' \quad (8),$$

where $(x_i, y_i)$ indicates to a coordinate of the ith grey level to show white in a CIE1931 color space, $Lv_i$ and $Lv_i'$ indicate to the ideal luminance values for showing white at an ith grey level applied on the pixel in the front view and in the side view, respectively, and $$S=RM_i(X)+RM_i(Y)+RM_i(Z)+GM_i(X)+GM_i(Y)+GM_i(Z)+BM_i(X)+BM_i(Y)+BM_i(Z)+RS_i(X)+RS_i(Y)+RS_i(Z)+GS_i(X)+GS_i(Y)+GS_i(Z)+BS_i(X)+BS_i(Y)+BS_i(Z),$$

$$S'=RM_i(X)'+RM_i(Y)'+RM_i(Z)'+GM_i(X)'+GM_i(Y)'+GM_i(Z)'+BM_i(X)'+BM_i(Y)'+BM_i(Z)'+RS_i(X)'+RS_i(Y)'+RS_i(Z)'+GS_i(X)'+GS_i(Y)'+GS_i(Z)'+BS_i(X)'+BS_i(Y)'+BS_i(Z)',$$

Where $RM_i(X)$, $RM_i(Y)$, $RM_i(Z)$ indicate to tristimulus values of the grey level $RM_i$ applied on the main subpixel region of the red subpixel in the front view, $RM_i(X)'$, $RM_i(Y)'$, $RM_i(Z)'$ indicate to tristimulus values of the grey level $RM_i$ applied on the main subpixel region of the red subpixel in the side view, $RS_i(X)$, $RS_i(Y)$, $RS_i(Z)$ indicate to tristimulus values of the grey level $RS_i$ applied on the secondary subpixel region of the red subpixel in the front view, $RS_i(X)'$, $RS_i(Y)'$, $RS_i(Z)'$ indicate to tristimulus values of the grey level $RS_i$ applied on the secondary subpixel region of the red subpixel in the side view, $GM_i(X)$, $GM_i(Y)$, $GM_i(Z)$ indicate to tristimulus values of the grey level $GM_i$ applied on the main subpixel region of the green subpixel in the front view, $GM_i(X)'$, $GM_i(Y)'$, $GM_i(Z)'$ indicate to tristimulus values of the grey level $GM_i$ applied on the main subpixel region of the green subpixel in the side view, $GS_i(X)$, $GS_i(Y)$, $GS_i(Z)$ indicate to tristimulus values of the grey level $GS_i$ applied on the secondary subpixel region of the green subpixel in the front view, $GS_i(X)'$, $GS_i(Y)'$, $GS_i(Z)'$ indicate to tristimulus values of the grey level $GS_i$ applied on the secondary subpixel region of the green subpixel in the side view, $BM_i(X)$, $BM_i(Y)$, $BM_i(Z)$ indicate to tristimulus values of the grey level $BM_i$ applied on the main subpixel region of the blue subpixel in the front view, $BM_i(X)'$, $BM_i(Y)'$, $BM_i(Z)'$ indicate to tristimulus values of the grey level $BM_i$ applied on the main subpixel region of the blue subpixel in the side view, $BS_i(X)$, $BS_i(Y)$, $BS_i(Z)$ indicate to tristimulus values of the grey level $BS_i$ applied on the secondary subpixel region of the blue subpixel in the front view, and $BS_i(X)'$, $BS_i(Y)'$, $BS_i(Z)'$ indicate to tristimulus values of the grey level $BS_i$ applied on the secondary subpixel region of the blue subpixel in the side view.

In this embodiment, $x_n$, $x_{n+1}$ . . . , $x_m$ are identical (e.g. if n is equal to 0, and m is equal to 255, $x_0$, $x_1$ . . . , $x_{255}$ are identical), or different by a few shift of 0.015 or less than 0.02. Similarly, $y_n$, $y_{n+1}$ . . . , $y_m$ are identical (e.g. if n is equal to 0, and m is equal to 255, $y_0$, $y_1$ . . . , $y_{255}$ are identical), or different by a few shift of 0.015 or less than 0.02.

Preferably, the predetermined criterion is one of the following criteria: $\Delta=\Delta1+\Delta2+\Delta3+\Delta4+\Delta5+\Delta6$ is minimum, or $\Delta=\Delta1^2+\Delta2^2+\Delta3^2+\Delta4^2+\Delta5^2+\Delta6^2$ is minimum, or $\Delta=a\Delta1^2+b\Delta2^2+c\Delta3^2+d\Delta4^2+e\Delta5^2+f\Delta6^2$ is minimum, where a, b, c, d, e, and f are weighed factors. The values of a, b, c, d, e, and f can be set based on design requirements.

In one aspect, the method of the present invention can be realized as a software program codes. In another aspect, the actual grey levels for showing white at all grey levels, applied on the main subpixel region and the secondary subpixel region of the pixel, can be calculated by using the method as disclosed above and stored in a lookup table. The LCD device is capable of looking up in the lookup table the required grey level voltage applied on the main subpixel region and the secondary subpixel region of the pixel.

By using the method of the preferred embodiment of the present invention, the white balance procedures can be effectively processed, thus setting gray levels of pixels imaging of LCD panels effectively and precisely, reducing problems common in wide-angle displays such as color shift and light leakage.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of setting grey levels of pixels on a liquid crystal display (LCD) panel, each pixel comprising a red subpixel, a green subpixel, and a blue subpixel, and each subpixel comprising a main subpixel region and a secondary subpixel region, the method comprising:

acquiring tristimulus values of each grey level applied on the main subpixel region and tristimulus values of each grey level applied on the secondary subpixel region in a front view, and acquiring tristimulus values of each grey level applied on the main subpixel region and tristimulus values of each grey level applied on the secondary subpixel region in a side view;

acquiring ideal luminance values for showing white at an ith grey level applied on the pixel in the front view and in the side view, where $i\in[m,n]$,m indicates a minimum grey level applied on the pixel and n indicates a maximum grey level applied on the pixel;

determining actual grey levels for showing white at the ith grey level which are applied on the main subpixel region and the secondary subpixel region of all pixels, according to the ideal luminance values, the tristimulus values of each grey level applied on the main subpixel region and applied on the secondary subpixel region in the front view, and tristimulus values of each grey level applied on the main subpixel region and applied on the secondary subpixel region in the side view wherein a step of determining actual grey levels for showing white at the ith grey level which are applied on the main subpixel region and the secondary subpixel region of all pixels, according to the ideal luminance values, the tristimulus values of each grey level applied on the main subpixel region and applied on the secondary subpixel region in the front view, and tristimulus values of each grey level applied on the main subpixel region and applied on the secondary subpixel region in the side view, comprises:

determining a grey level $RM_i$ as an actual grey level applied on a main subpixel region of the red subpixel, determining a grey level $RS_i$ as an actual grey level applied on a secondary subpixel region of the red subpixel, determining a grey level $GM_i$ as an actual grey level applied on a main subpixel region of the green subpixel, determining a grey level $GS_i$ as an actual grey level applied on a secondary subpixel region of the green subpixel, determining a grey level $BM_i$ as an actual grey level applied on a main subpixel region of the blue subpixel, determining a grey level $BS_i$ as an actual grey level applied on a secondary subpixel region of the blue subpixel, where the grey levels $RM_i$, $RS_i$, $GM_i$, $GS_i$, $BM_i$, and $BS_i$ indicate to the actual grey levels for showing white at the ith grey level, upon a condition that, and $\Delta6$ meet a predetermined criterion, where $\Delta1$, $\Delta2$, $\Delta3$, $\Delta4$, $\Delta5$, and $\Delta6$ are obtained based on the following formulas:

$$\Delta1=x_i-(RM_i(X)+GM_i(X)+BM_i(X)+RS_i(X)+GS_i(X)+BS_i(X))/S,$$

$$\Delta2=y_i-(RM_i(Y)+GM_i(Y)+BM_i(Y)+RS_i(Y)+GS_i(Y)+BS_i(Y))/S,$$

$$\Delta3=RM_i(Y)+GM_i(Y)+BM_i(Y)+RS_i(Y)+GS_i(Y)+BS_i(Y)-Lv_i,$$

$$\Delta4=x_i-(RM_i(X)'+GM_i(X)'+BM_i(X)'+RS_i(X)'+GS_i(X)'+BS_i(X)')/S',$$

$$\Delta5=y_i-(RM_i(Y)'+GM_i(Y)'+BM_i(Y)'+RS_i(Y)'+GS_i(Y)'+BS_i(Y)'/S',$$

$$\Delta6=RM_i(Y)'+GM_i(Y)'+BM_i(Y)'+RS_i(Y)'+GS_i(Y)'+BS_i(Y)'-Lv_i',$$

where $(x_i, y_i)$ indicates to a coordinate of the ith grey level to show white in a CIE1931 color space, $Lv_i$ and $Lv_i'$ indicate to the ideal luminance values for showing white at an ith grey level applied on the pixel in the front view and in the side view, respectively, and $$S=RM_i(X)+RM_i(Y)+RM_i(Z)+GM_i(X)+GM_i(Y)+GM_i(Z)+BM_i(X)+BM_i(Y)+BM_i(Z)+RS_i(X)+RS_i(Y)+RS_i(Z)+GS_i(X)+GS_i(+GS_i(Z)+BS_i(X)+BS_i(Y)+BS_i(Z),$$

$$S'=RM_i(X)'+RM_i(Y)'+RM_i(Z)'+GM_i(X)'+GM_i(Y)'+GM_i(Z)'+BM_i(X)'+BM_i(Y)'+BM_i(Z)'+RS_i(X)'+RS_i(Y)'+RS_i(Z)'+GS_i(X)'+GS_i(Y)'+GS_i(Z)'+BS_i(X)'+BS_i(Y)'+BS_i(Z)',$$

where $RM_i(X)$, $RM_i(Y)$, $RM_i(Z)$ indicate to tristimulus values of the re level $RM_i$ applied on the main subpixel region of the red subpixel in the front view $RM_iX'$, $RM_i(Y)'$, $RM_i(Z)'$ indicate to tristimulus values of the grey level $RM_i$ applied on the main subpixel region of the red subpixel in the side view, $RS_i(X)$, $RS_i(Y)$, $RS_i(Z)$ indicate to tristimulus values of the grey level $RS_i$ applied on the secondary subpixel region of the red subpixel in the front view $RS_iX'$, $RS_i(Y)'$, $RS_i(Z)'$ indicate to tristimulus values of the grey level $RS_i$ applied on the secondary subpixel region of the red subpixel in the side view, $GM_i(X)$, $GM_i(Y)$, $GM_i(Z)$ indicate to tristimulus values of the grey level $GM_i$ applied on the main subpixel region of the green subpixel in the front view $GM_iX'$, $GM_i(Y)'$, $GM_i(Z)'$ indicate to tristimulus values of the grey level $GM_i$ applied on the main subpixel re ion of the subpixel in the front view, $GS_i(X)$, $GS_i(Y)$, $GS_i(Z)$ indicate to tristimulus values of the grey level $GS_i$ applied on the secondary subpixel region of the subpixel in the front view, $GS_i(X)'$, $GS_i(Y)'$, $GS_i(Z)'$ indicate to tristimulus values of the grey level $GS_i$ applied on the secondary subpixel region of the green subpixel in the side view $BM_i(X)$, $BM_i(Y)$, $BM_i(Z)$ indicate to tristimulus values of the grey level $BM_i$ applied on the main subpixel region of the blue subpixel in the front view, $BM_i(X)'$, $BM_i(Y)'$, $BM_i(Z)'$ indicate to tristimulus values of the re level $BM_i$ applied on the main subpixel region of the blue subpixel in the side view $BS_i(X)$, $BS_i(Y)$, $BS_i(Z)$ indicate to tristimulus values of the grey level $BS_i$ applied on the secondary subpixel region of the blue subpixel in the front view, and $BS_i(X)$, $BS_i(Y)'$, $BS_iZ'$ indicate to tristimulus values of the grey level $BS_i$ applied on the secondary subpixel region of the blue subpixel in the side view.

2. The method of claim 1, wherein the predetermined criterion is one of the following criteria: $\Delta=\Delta1+\Delta2+\Delta3+\Delta4+\Delta5+\Delta6$ is minimum, or $\Delta=\Delta1^2+\Delta2^2+\Delta3^2+\Delta4^2+\Delta5^2+\Delta6^2$ is minimum, or $\Delta=a\Delta1^2+b\Delta2^2+c\Delta3^2+d\Delta4^2+e\Delta5^2+f\Delta6^2$ is minimum, where a, b, c, d, e, and f are weighed factors.

3. The method of claim 1, wherein a step of acquiring ideal luminance values for showing white at an ith grey level applied on the pixel in the front view and in the side view, comprises:

acquiring ideal luminance values $Lv_i$ and $Lv_i'$ for showing white at an ith grey level applied on the pixel in the front view and in the side view based on following equations:

$$Lv_i=Lv(n)*(i/n)^{\gamma}, \text{ and}$$

$$Lv_i'=Lv(n)'*(i/n)^{\gamma},$$

where Lv(n) and Lv(n)' indicate to actual luminance values for showing white at an nth grey level applied on the pixel in the front view and in the side view, respectively, and γ is a predetermined gamma value.

4. The method of claim 3, wherein γ is equal to 2.2.

5. The method of claim 1, wherein m is equal to 0, and n is equal to 255.

6. The method of claim 1, wherein the front view indicates an observer view the LCD panel in a viewing angle of 0° from a perpendicular direction of the LCD panel, and the side view indicates an observer view the LCD panel in a predetermined viewing angle from the perpendicular direction of the LCD panel.

7. The method of claim 6, wherein the predetermined viewing angle is 60°.

* * * * *